US010514645B2

(12) United States Patent
Hara et al.

(10) Patent No.: US 10,514,645 B2
(45) Date of Patent: Dec. 24, 2019

(54) IMAGE FORMING APPARATUS

(71) Applicant: CANON KABUSHIKI KAISHA, Tokyo (JP)

(72) Inventors: Jun Hara, Kawasaki (JP); Kenichi Iida, Tokyo (JP); Ryuji Hamasaki, Tokyo (JP); Keisuke Yoshida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/249,923

(22) Filed: Jan. 17, 2019

(65) Prior Publication Data

US 2019/0227472 A1 Jul. 25, 2019

(30) Foreign Application Priority Data

Jan. 23, 2018 (JP) ..... 2018-009050

(51) Int. Cl.
*G03G 15/00* (2006.01)
*G03G 15/08* (2006.01)
*G03G 21/00* (2006.01)

(52) U.S. Cl.
CPC ..... *G03G 15/5045* (2013.01); *G03G 15/0865* (2013.01); *G03G 21/0005* (2013.01)

(58) Field of Classification Search
CPC ..... G03G 15/0865; G03G 15/5045; G03G 21/10; G03G 21/12; G03G 21/1889; G03G 21/20; G03G 21/2005; G03G 2215/772; G03H 21/105
USPC ..... 399/34, 35, 38, 43, 44, 107, 110, 111, 399/343, 350, 351, 358–360
See application file for complete search history.

(56) References Cited

U.S. PATENT DOCUMENTS 8,731,417 B2 * 5/2014 Shiori ..... G03G 21/20 399/44
8,781,346 B2 * 7/2014 Odani ..... G03G 15/50 399/44
9,025,977 B2 * 5/2015 Sugiyama ..... G03G 21/20 399/44

(Continued)

FOREIGN PATENT DOCUMENTS

JP 2007-286579 A 11/2007

*Primary Examiner* — Hoan H Tran
(74) *Attorney, Agent, or Firm* — Venable LLP

(57) ABSTRACT

An image forming apparatus includes a container that contains a developer, a temperature information acquisition unit that acquires temperature information of the container, and a control unit that controls an image formation operation for forming an image. During the image formation operation, the control unit executes a suspension operation for suspending the image formation operation in the case that $t \geq t_{oth}(t_{oth} \neq 0)$ is satisfied, where t is defined to be an elapsed time from when a temperature corresponding to the temperature information of the container exceeds a predetermined threshold temperature $T_{th}$, and where $t_{oth}$ is defined to be an exceeding time threshold value related to a period during which the temperature corresponding to the temperature information of the container remains higher than the threshold temperature $T_{th}$.

18 Claims, 9 Drawing Sheets

(56) References Cited

U.S. PATENT DOCUMENTS

| | | | | |
|---|---|---|---|---|
| 9,229,398 | B2 * | 1/2016 | Tomono | G03G 15/50 |
| 10,018,950 | B2 * | 7/2018 | Kato | G03G 15/0865 |

* cited by examiner

IMAGE FORMING APPARATUS

BACKGROUND OF THE INVENTION

Field of the Invention

The present invention relates to an image forming apparatus such as a copier, a printer, or a facsimile machine that uses an electrophotographic system or an electrostatic recording system.

Description of the Related Art

Conventionally, for example, in an image forming apparatus that uses an electrophotographic system, an electrophotographic photosensitive member (photosensitive member) is uniformly charged and is then exposed in accordance with image information, and an electrostatic latent image is thereby formed on the photosensitive member. The electrostatic latent image is developed as a toner image using toner, and is then transferred to a recording material such as recording paper directly or via an intermediate transfer member by a transfer unit. Thereafter, the toner image transferred to the recording material is heated and fixed on the recording material by a fixing unit, and the toner image is thereby formed on the recording material. When the temperature of the toner extremely increases, sticking of the toner occurs due to an increase in the viscosity of the toner. In an image forming apparatus in which a cartridge having a waste toner container for containing waste toner remaining on an image bearing member after transfer is installed, when the temperature of the cartridge increases, the temperature of the waste toner container also increases. When the sticking of the toner in the vicinity of the inlet of the waste toner container occurs due to the increase in the temperature of the waste toner container, the inlet of the container is blocked, and the waste toner is not collected into the waste toner container even when the waste toner is on the photosensitive member. Thus, when the waste toner on the photosensitive member is not collected into the waste toner container, the toner image remains on the photosensitive member, and faulty cleaning that allows an image different from the original toner image to be transferred to the recording material occurs. In addition, when the temperature of a developer container that contains toner used for developing the electrostatic latent image on the photosensitive member increases, the sticking of the contained toner occurs, and degradation of the toner progresses.

In order to prevent the occurrence of faulty cleaning caused by the increase in the temperature of the cartridge, there is proposed a technique disclosed in Japanese Patent Application Publication No. 2007-286579. Japanese Patent Application Publication No. 2007-286579 proposes a configuration in which, in order to prevent the occurrence of the sticking of the toner, the temperature of the cartridge is detected, and the operation of a main body is controlled such that the temperature is not higher than a predetermined threshold temperature such as the glass transition temperature (Tg) of the toner or the like.

SUMMARY OF THE INVENTION

However, in the case where the glass transition temperature (Tg) of the toner is exceeded, the toner does not necessarily stick together immediately. As in Japanese Patent Application Publication No. 2007-286579, in the configuration in which the main body operates such that the threshold temperature is not exceeded, there are cases where the operation of the main body is excessively limited, and the productivity of printing is thereby reduced.

An object of the present invention is to provide an image forming apparatus capable of improving productivity while preventing an image ill effect such as faulty cleaning caused by sticking of toner or the like.

In order to achieve the above object, an image forming apparatus of the present invention includes:

a container configured to contain a developer;

a temperature information acquisition unit configured to acquire temperature information of the container; and a control unit configured to control an image formation operation for forming an image, wherein, in the image formation operation, the control unit executes a suspension operation for suspending the image formation operation in a case that $t \geq t_{oth}$ ($t_{oth} \neq 0$) is satisfied, where t is defined to be an elapsed time from when a temperature corresponding to the temperature information of the container exceeds a predetermined threshold temperature $T_{th}$, and where $t_{oth}$ is defined to be an exceeding time threshold value related to a period during which the temperature corresponding to the temperature information of the container remains higher than the threshold temperature $T_{th}$.

In addition, an image forming apparatus of the present invention includes:

a container configured to contain a developer;

a temperature information acquisition unit configured to acquire temperature information of the container; and a control unit configured to control an image formation operation for forming an image on a recording material, wherein, in the image formation operation, the control unit executes a suspension operation in a case that $p \geq p_{oth}$ is satisfied, where p is defined to be a number of sheets of the recording material on which the image is formed after a temperature corresponding to the temperature information of the container exceeds a predetermined threshold temperature $T_{th}$, and where $p_{oth}$ ($p_{oth} \neq 0$) is defined to be a threshold value of the number of sheets of the recording material on which the image can be formed from when the temperature corresponding to the temperature information of the container exceeds the threshold temperature $T_{th}$ until when a suspension operation for suspending the image formation operation is executed.

Further, an image forming apparatus of the present invention includes:

a container configured to contain a developer;

an elapsed time acquisition unit configured to acquire information on an elapsed time from when an image formation operation for forming an image on a recording material is ended; and a control unit configured to control the image formation operation, wherein, the control unit controls such that the number of sheets of the recording material on which the image can be formed in a next image formation operation in a case that the elapsed time t is not less than a predetermined elapsed time threshold value $t_{th}$, is greater than that in a case that the elapsed time t is less than the elapsed time threshold value $t_{th}$, where t is defined to be an elapsed time from when a previous image formation operation is ended until when the next image formation operation is started.

In addition, an image forming apparatus of the present invention includes:

a container configured to contain a developer;

an elapsed time acquisition unit configured to acquire information on an elapsed time from when an image formation operation for forming an image on a recording material is ended; and a control unit configured to control the image formation operation, the control unit having:

a first mode in which the image formation operation is suspended when a first time elapses from a start of the image formation operation; and a second mode in which the image formation operation is suspended when a second time longer than the first time elapses from the start of the image formation operation, wherein the control unit selects one of the first mode and the second mode to execute based on an elapsed time from when a previous image formation operation is suspended when the image formation operation is started.

According to the present invention, it becomes possible to improve productivity while preventing an image ill effect such as faulty cleaning caused by sticking of toner or the like.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Configuration of Image Forming Apparatus

Figure 1:
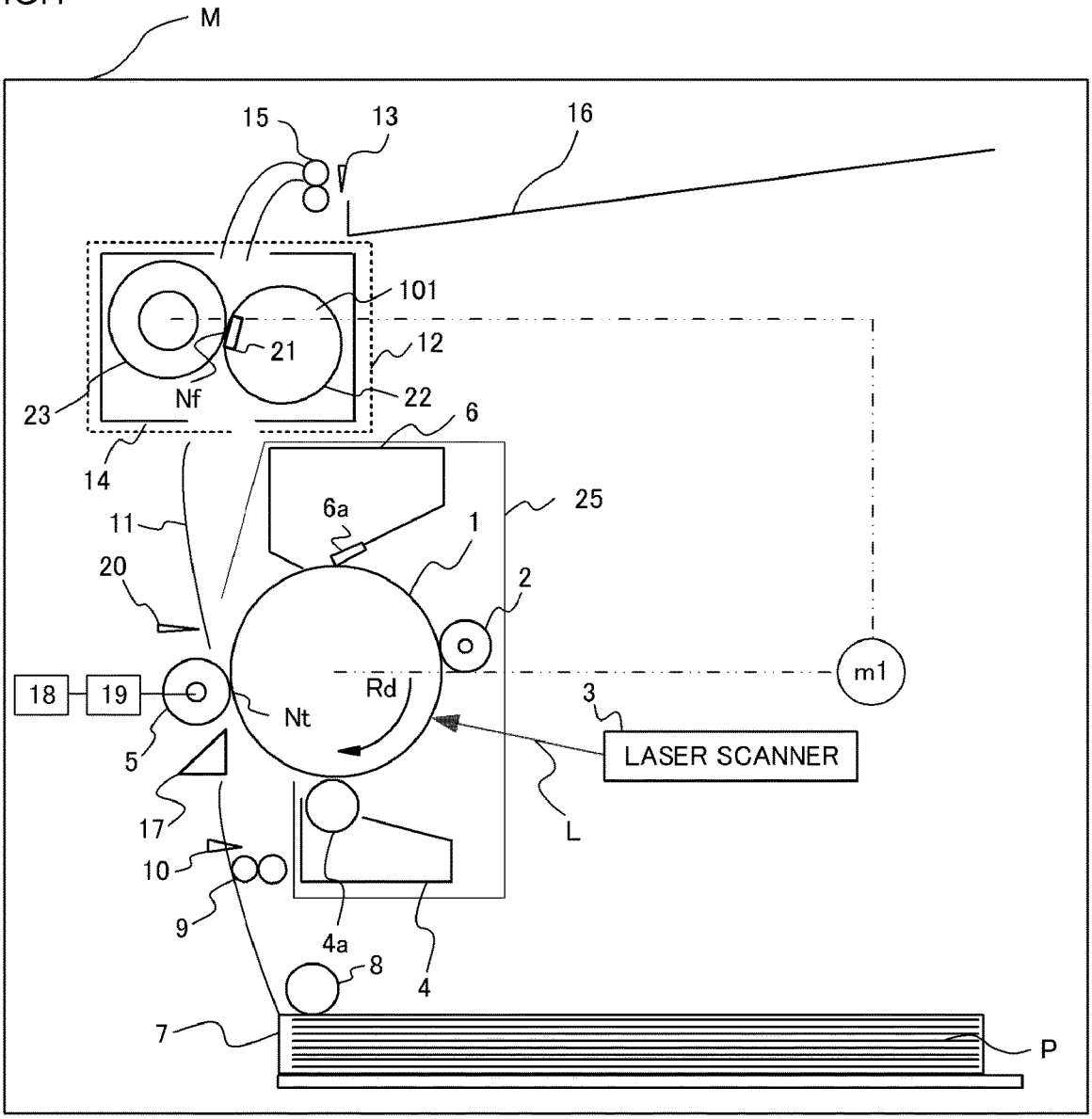
FIG. 1 is a schematic cross-sectional view of an image forming apparatus of Embodiment 1.

FIG. 1 is a cross-sectional view of a principal portion of an image forming apparatus such as a laser beam printer according to an embodiment of the present invention.

An image forming apparatus M includes, as an image bearing member, a photosensitive drum 1 serving as a drum-type (cylindrical) electrophotographic photosensitive member (photosensitive member). The photosensitive drum 1 is constituted by providing a photosensitive material such as an OPC (organic photo-semiconductor), amorphous selenium, or amorphous silicon on a cylindrical drum substrate formed of aluminum or nickel. The photosensitive drum 1 is rotatably supported in the apparatus main body M, and is rotationally driven at a process speed (peripheral speed) of 118 mm/second in a direction of an arrow Rd in the drawing by a driving source m1. In the present embodiment, the outer diameter of the photosensitive drum 1 is 24 mm.

The following units are disposed around the photosensitive drum 1 successively along its rotation direction. First, a charging roller 2 serving as a roller-shaped charging member is disposed as a charging unit. Next, an exposing apparatus (laser scanner) 3 serving as an exposure unit is disposed. Next, a developing apparatus 4 serving as a development unit is disposed. Next, a transfer roller 5 serving as a roller-shaped transfer member is disposed as a transfer unit. The transfer roller 5 is an example of the transfer unit that holds a recording material (transfer material) P between the transfer unit and the photosensitive drum 1, and transfers a toner image from the photosensitive drum 1 to the recording material P using voltage applied to the transfer unit. Next, a cleaning apparatus 6 serving as a cleaning unit is disposed.

In addition, in the lower portion of the apparatus main body M in the drawing, a recording material cassette 7 in which the recording material P such as paper is stored is disposed. Further, a paper feed roller 8, a transport roller 9, a top sensor 10, a pre-transfer guide 17, a transport guide 11, a fixing apparatus 12, a paper discharge sensor 13, a paper discharge roller 15, and a paper discharge tray 16 are disposed in this order along the transport path of the recording material P from the recording material cassette 7. An environment sensor that is not shown is disposed in the apparatus main body, and it is possible to detect outside air temperature around the apparatus with the environment sensor.

Operation of Paper Feed Section

The recording material P is stored in the recording material cassette 7, sent out sheet by sheet by the paper feed roller 8, and transported by the transport roller 9 to a transfer nip (Nt) along the pre-transfer guide 17 serving as a guide member. At this point, the top of the recording material P is detected by the top sensor 10, and image formation on the photosensitive drum 1 is synchronized with the detection thereof.

Image Formation Operation

The photosensitive drum 1 is rotationally driven in the direction of the arrow Rd in the drawing by the driving source m1. The surface of the rotating photosensitive drum 1 is substantially uniformly charged at a predetermined potential of predetermined polarity (negative polarity in the present embodiment) by the charging roller 2. At this point, a charging bias (charging voltage) is applied to the charging roller 2 from a charging power source (high-voltage power source) that is not shown. The charged surface of the photosensitive drum 1 is subjected to image exposure L based on image information by the exposing apparatus 3, electric charge in the exposed portion is removed, and an electrostatic latent image is formed. The electrostatic latent image formed on the photosensitive drum 1 is developed as the toner image by the developing apparatus 4. That is, the toner image serving as a developer image is borne on the photosensitive drum 1. The developing apparatus 4 has a developing roller 4*a* serving as a developer bearing member that supplies toner to an opposing portion (development portion) that opposes the photosensitive drum 1. A developing bias is applied to the developing roller 4*a* from a developing power source that is not shown, whereby toner adheres to the electrostatic latent image on the photosensitive drum 1 and the electrostatic latent image is developed as the toner image. In the present embodiment, the toner image is formed by the reversal development method in which toner, which is charged with the same polarity as the charging polarity of the photosensitive drum 1, is caused to adhere to an exposed portion that is reduced in the absolute value of the potential by being uniformly charged and then exposed.

Configuration of Transfer Section

The toner image formed on the photosensitive drum 1 is transferred to the recording material P such as paper by the operation of the transfer roller 5. The transfer roller 5 is pressed toward the photosensitive drum 1 by a transfer pressure spring that is not shown, and is in pressure contact with the photosensitive drum 1. With this, the transfer nip (transfer holding portion) Nt is formed as a contact portion between the photosensitive drum 1 and the transfer roller 5. The transfer roller 5 rotates in response to the rotation of the photosensitive drum 1. The transfer roller 5 holds the recording material P between the transfer roller 5 and the photosensitive drum 1, and transports the recording material P. At this point, a transfer bias having polarity opposite to the charging polarity of the toner during the development is applied to the transfer roller 5 from a transfer power source 18. With this, the toner image on the photosensitive drum 1 is transferred to a predetermined position on the recording material P. A current flowing to the transfer roller 5 can be detected by a transfer current detection circuit 19, and feedback to transfer control is allowed.

The transfer roller 5 used in the present embodiment is constituted by forming an elastic layer formed of a conductive rubber material on the surface of a core metal, and the electrical resistance value of the transfer roller is adjusted to $10^7$ to $10^9\Omega$. The transfer roller 5 has an outer diameter $\phi$ of 12.5 mm, a core metal diameter $\phi$ of 5 mm, and a rubber thickness t of 3.75 mm.

The surface charge of the recording material P to which the toner image is transferred in the transfer nip (Nt) is removed by a charge removing member 20, and the recording material P is transported along the transport guide 11 to the fixing apparatus 12. On the other hand, with regard to the photosensitive drum 1 after the toner image is transferred to the recording material P, untransferred toner remaining on the surface of the photosensitive drum 1 without being transferred to the recording material P is removed by a cleaning blade 6*a* of the cleaning apparatus 6, and the photosensitive drum 1 is used in the next image formation.

Configuration of Fixing Section

A heater 21 serving as a heating member is held by a heater holder 101, and a flexible fixing film 22 is provided around the heater 21 using an endless belt. The heater 21 comes into contact with the inner surface of the fixing film 22, is pressed by a pressure roller 23 to form a fixing nip (Nf), and heats the fixing film 22 from the inside. An AC voltage is applied to the heater 21 from a commercial power source via a triac or the like, and the heater 21 is heated to a predetermined temperature adjusted by turning ON/OFF the triac. Consequently, an unfixed toner image on the recording material P transported to the fixing nip (Nf) is fixed to the recording material P by pressurization and heating. A distance between a fixing unit cover 14 and a cartridge 25 is about 5 mm. In the image forming apparatus having such a configuration, heat generated from the fixing apparatus 12 accelerates increases in the temperature of the inside of the main body of the image forming apparatus and the temperature of the cartridge installed in the image forming apparatus, and the temperature of the toner stored in the cartridge also increases. Consequently, the above-described faulty cleaning caused by the occurrence of sticking of the toner in the vicinity of the inlet of the waste toner container may occur. In addition, in the case where the size of the main body of the image forming apparatus is reduced, a distance between the cartridge container and the fixing apparatus is reduced, and heat of the fixing apparatus is conducted to the cartridge side more easily. Further, in the case where a cooling fan for cooling the inside of the apparatus is not used for the purpose of reducing cost, the temperature in the cartridge increases more easily, and the occurrence of the above-described faulty cleaning or the like is facilitated. According to the image forming apparatus of the present embodiment, it is possible to improve productivity while preventing the occurrence of the faulty cleaning or the like.

Heater

The heater 21 of the present embodiment is a typical heater used in a film heating type heating apparatus, and the heater in which resistance heating elements are provided in series on a ceramic substrate is used as the heater 21. In the heater 21, the surface of an alumina substrate 207 having a width of 6 mm in a transport direction and a thickness of 1 mm is coated with a resistance heating element made of Ag/Pd (silver-palladium) having a thickness of 10 μm by screen printing, and is covered with glass having a thickness of 60 μm that serves as a heating element protective layer. Conductive electrodes are provided at ends of the resistance heating element, and the resistance heating element is caused to generate heat by the passage of electric current from the electrodes. A temperature sensor (thermistor) that is not shown is disposed on the back surface of the heater, and detects the temperature in the fixing unit. The temperature of the heater 21 is adjusted by properly controlling the electric current passed through the resistance heating element from the electrode portions in accordance with a signal of this temperature detection element.

Operation After Fixing

The recording material P to which the toner image has been fixed by the fixing apparatus 12 is transported by the paper discharge roller 15, and is discharged onto the paper discharge tray 16 formed on the upper surface of the apparatus main body M in the drawing. At this point, the paper discharge sensor 13 detects the rear end of the recording material P for determination of the presence or absence of jamming.

By repeating the above operations, it is possible to perform the image formation successively. In the present embodiment, a distance between the recording materials (inter-paper distance) on the transport path during continuous printing is 55 mm, and the recording material is discharged at a printing speed of 20 sheets per minute.

Image Formation Control

Figure 2:
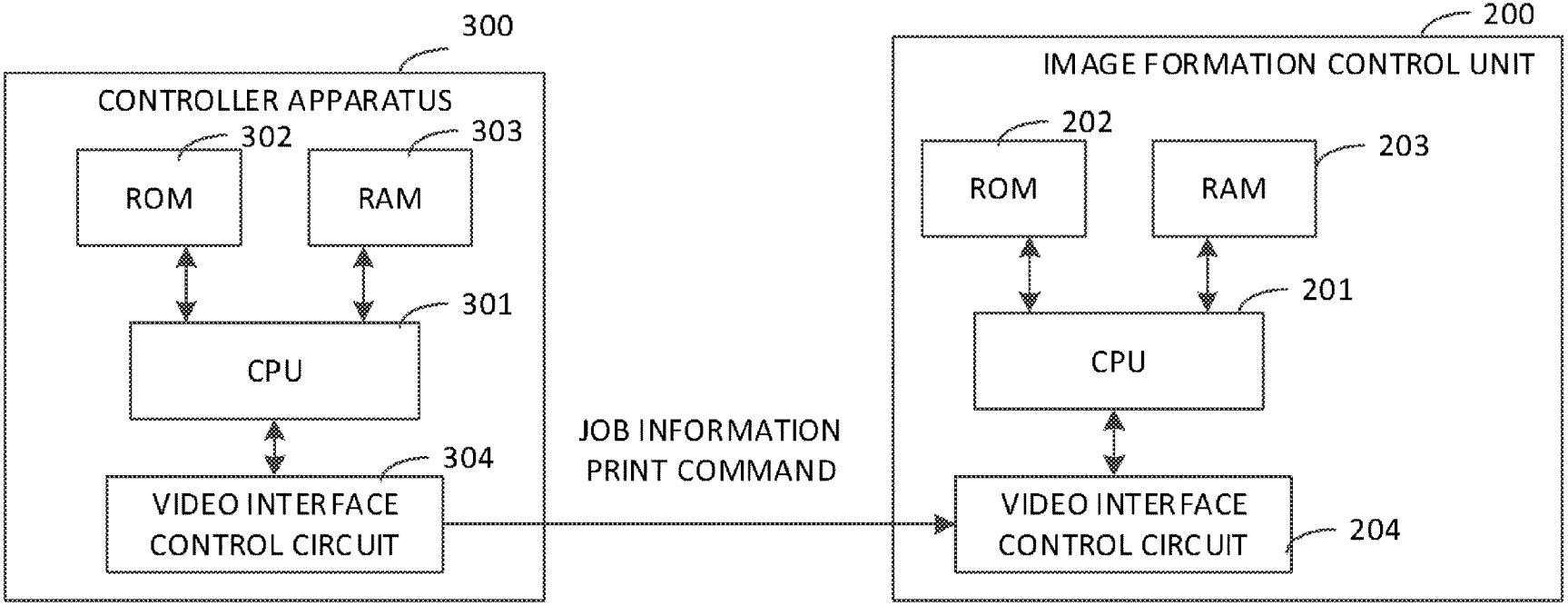
FIG. 2 is a schematic view of a control system block of the image forming apparatus of Embodiment 1.

FIG. 2 is a block diagram of a control system of the image forming apparatus. An image formation control unit 200 includes a CPU 201 that controls the entire image forming apparatus, a ROM 202 in which a control program is stored, and a RAM 203 in which data or the like is stored. The image formation control unit 200 can communicate with a controller apparatus 300 described later via a video interface control circuit 204. As an elapsed time acquisition unit that acquires elapsed time information related to an elapsed time from a specific point of time in the image forming apparatus, the CPU 201 executes a predetermined program to implement the function of a timer based on a clock (not shown) that is provided in the image formation control unit 200.

The controller apparatus 300 includes a CPU 301 that controls the entire controller apparatus, a ROM 302 in which a control program is stored, and a RAM 303 in which data or the like is stored. The controller apparatus 300 is connected to an apparatus (not shown) such as an image reading apparatus or a computer, and the image formation control unit 200 via a video interface control circuit 304.

Temperature Increase Prevention Sequence

Figure 3:
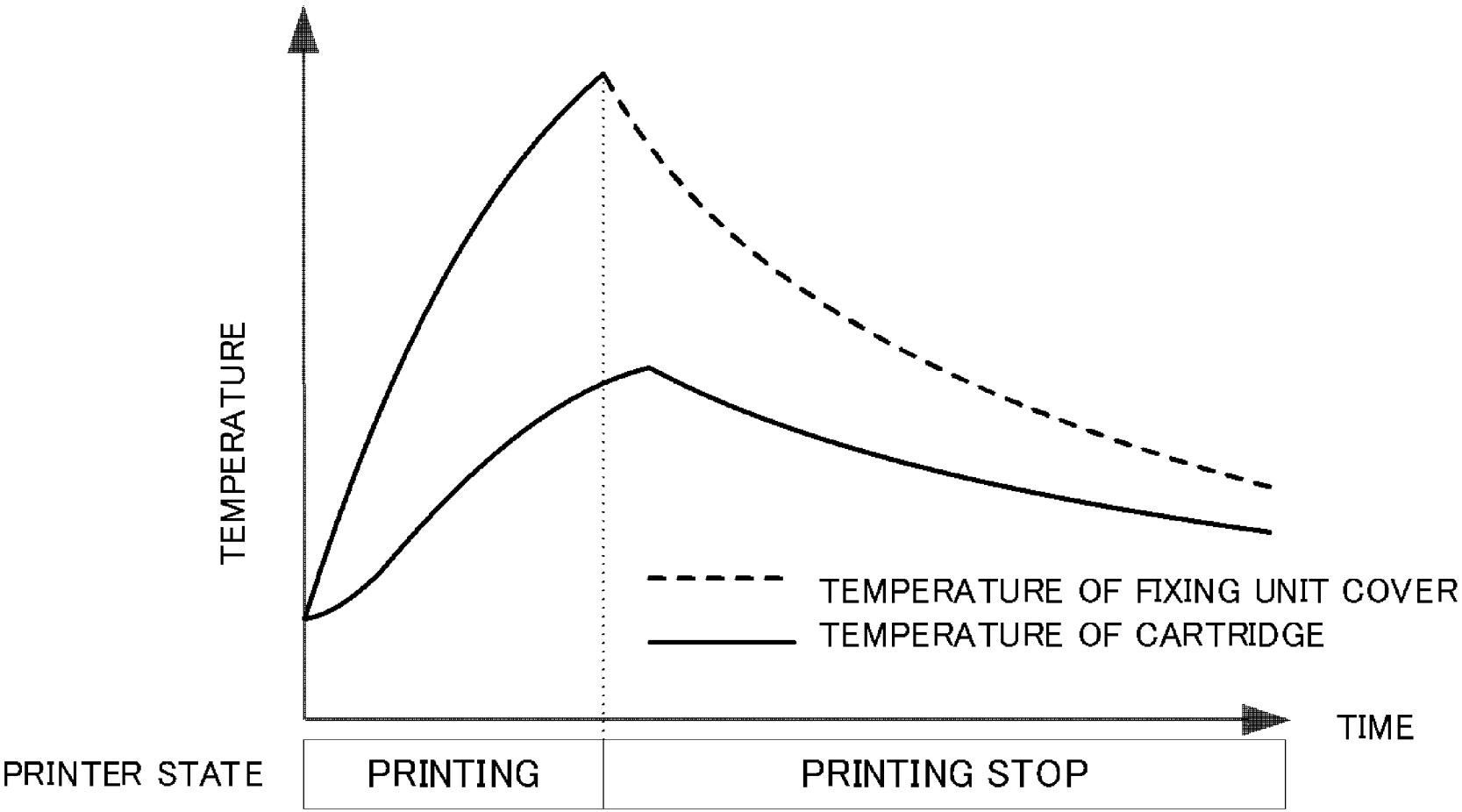
FIG. 3 is a view showing a temperature increase image of each of a fixing unit cover and a cartridge in Embodiment 1.

In the case where the present image forming apparatus has performed an image formation operation for a long time, when the temperature of the cartridge 25 is higher than a predetermined threshold temperature for a specific period or longer, the viscosity of the toner increases and the toner sticks together, and hence it is necessary to stop the image formation operation during its execution with a temperature increase prevention sequence. FIG. 3 shows a temperature change graph of each of the fixing unit cover 14 and the cartridge 25. During a printing operation, the cartridge 25 and the fixing unit cover 14 are influenced by the temperature of the heater 21 in the fixing unit, and the temperature of each of the cartridge 25 and the fixing unit cover 14 increases toward a temperature at which the amount of heat dissipation and the amount of heat generation achieve thermal equilibrium. When the printing operation is ended, the heater 21 stops heating, and hence the temperature of the fixing unit cover 14 that has lost a heat source decreases toward room temperature. On the other hand, after the stop of the heater, the fixing unit cover 14 higher in temperature than the cartridge 25 serves as the heat source for the cartridge 25, and hence the temperature of the cartridge 25 changes so as to approach the temperature of the fixing unit cover 14. As a result, the cartridge 25 behaves such that the temperature thereof slightly increases after the stop of the printing operation, and then gradually decreases.

Figure 4:
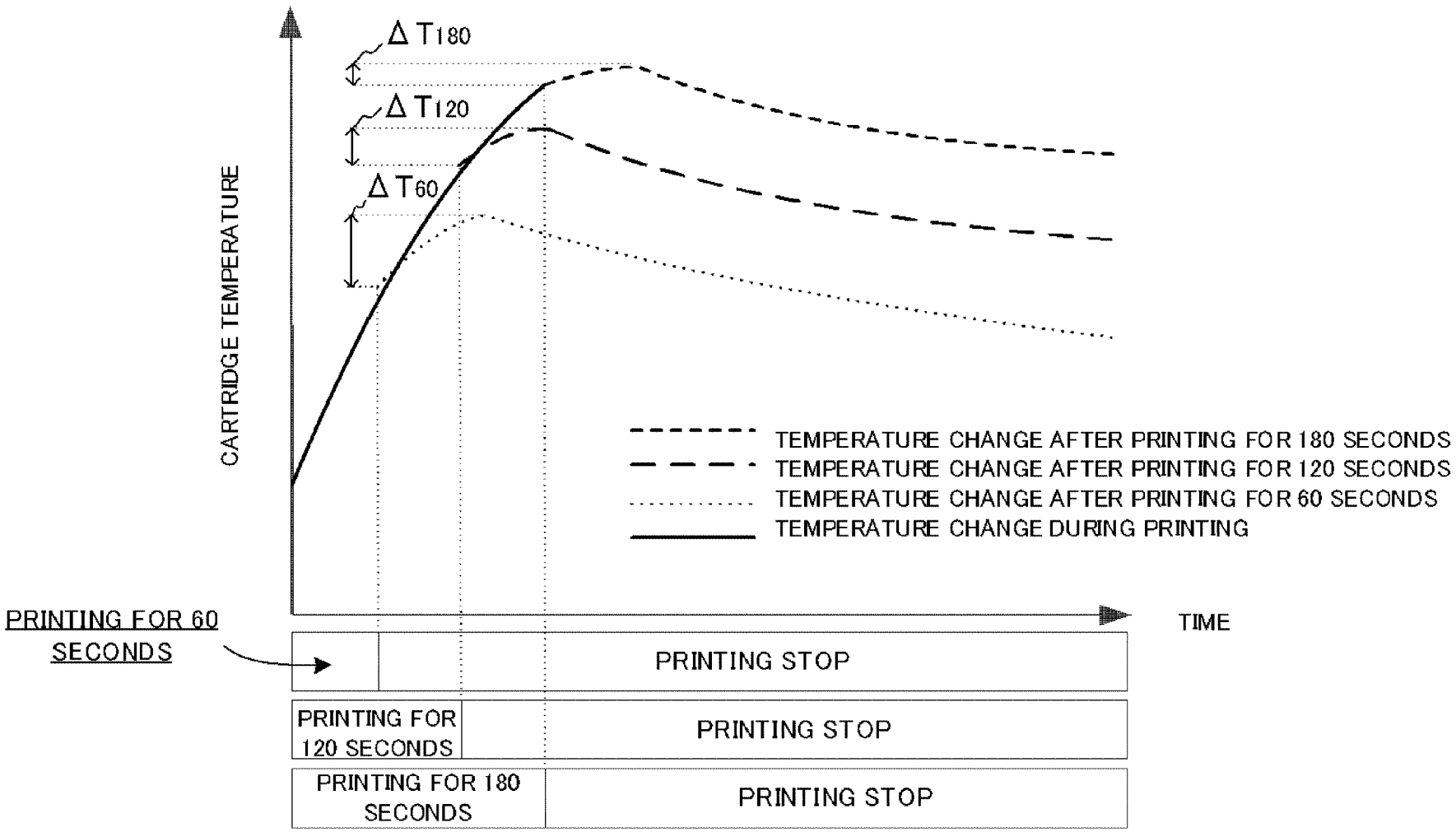
FIG. 4 is a view showing the temperature increase image of the cartridge in Embodiment 1.

FIG. 4 is a graph in which changes of the temperature of the cartridge 25 after the end of the printing are compared with each other while a continuous printing time is changed. The amount and the speed of an increase in the temperature of the cartridge 25 after the end of the printing depend on a difference in temperature between the cartridge 25 and the fixing unit cover 14 when the printing operation is ended. The fixing unit cover 14 is positioned in the vicinity of the heater 21, and has a heat capacity smaller than that of the cartridge 25, and hence the temperature of the fixing unit cover 14 sharply increases immediately after the start of the printing, and converges before the temperature of the cartridge 25 converges (see FIG. 3). That is, as the number of prints increases, the difference in temperature between the cartridge 25 and the fixing unit cover 14 when the printing operation is ended decreases. Therefore, the amount of the temperature increase after the end of the printing decreases as the number of prints increases, and $\Delta T_{180}<\Delta T_{120}<\Delta_{60}$ is satisfied.

Glass Transition Temperature (Tg) of Toner

In the present embodiment, the threshold temperature of the cartridge is set in consideration of the glass transition temperature (Tg) of the toner. When the temperature in the cartridge exceeds the glass transition temperature (Tg) of the toner, the viscosity of the toner increases and, as a result, the toner aggregates and sticks together. To cope with this, the threshold temperature is set to be lower than the glass transition temperature (Tg) of the toner such that the temperature in the cartridge does not exceed the glass transition temperature (Tg) of the toner. The glass transition temperature (Tg) of the toner was 55° C. according to measurement shown below in the present embodiment, and hence the threshold temperature was set to 50° C.

The glass transition temperature (Tg) of the toner is measured according to ASTM D3418-82 by using a differential scanning calorimeter "Q1000" (manufactured by TA Instruments). The melting point of each of indium and zinc is used in temperature correction in an apparatus detection portion, and heat of fusion of indium is used in correction of the amount of heat. Specifically, 2 mg of a measurement sample is weighed exactly, the measurement sample is put in a pan made of aluminum, an empty pan made of aluminum is used as a reference, and the temperature is increased at a ramp rate of 10° C./minute in a measurement range of 0° C. to 150° C. The measurement sample is held for 15 minutes at 100° C., and is then cooled at a ramp down rate of 10° C./minute in a range of 100° C. to 0° C. The measurement sample is held for 10 minutes at 0° C. and, thereafter, the measurement is performed at a ramp rate of 10° C./minute in a range of 0° C. to 100° C. A temperature at a point where a straight line, which is equidistant in a longitudinal axis direction from straight lines obtained by extending base lines before and after a specific heat change of a specific heat change curve appears in the second ramp process, and a curve of a stepwise change part of glass transition intersect each other is determined to be the glass transition temperature (Tg) of the toner.

Measurement of Sticking Temperature and Sticking Time of Toner

The measurement of the sticking temperature and the sticking time of the toner was performed in the following manner. First, about 5 g of toner is put in a plastic cup, and is left to stand in a constant temperature bath. The plastic cup is taken out after being left to stand, and the state of sticking of the toner in the plastic cup is evaluated stepwise. When the toner did not stick together and was dry similarly to the state before being left to stand, "o" was assigned given to the toner. When the toner partially stuck together but was returned to the dry state by vibrations caused by shaking the plastic cup or the like, "Δ" was assigned to the toner. When the toner completely stuck together, "x" was assigned to the toner. The result is shown in Table 1.

TABLE 1

| | | Standing time | | | |
|---|---|---|---|---|---|
| | | 30 minutes | 1 hour | 2 hours | 3 hours |
| Temperature in constant temperature bath | 50° C. | ○ | ○ | ○ | ○ |
| | 55° C. | ○ | ○ | Δ | Δ |
| | 60° C. | ○ | Δ | x | x |
| | 65° C. | Δ | x | x | x |

Thus, when the temperature in the constant temperature bath is not more than 50° C., the toner does not stick together even when the toner is left to stand for a long time. When the toner is left to stand for two hours or more at 55° C., the toner becomes liable to stick together. When the toner is left to stand for one hour or more at 60° C., the toner tends to stick together. However, the toner does not stick together in the case where a period during which the temperature is at least 50° C. and not more than 60° C. is not more than 30 minutes.

Embodiment 1

Paper feed and the measurement of the cartridge temperature were performed under the following conditions.

Environment: 23° C./55% R.H. normal temperature and normal humidity (N/N) environment Main body: throughput 20 ppm, process speed 118 mm/sec Recording material: plain paper taken from newly opened package of A4-size Oce Red Label (basic weight 80 g/m$^2$)

Image: all white image

In the present embodiment, the temperature of the cartridge is estimated based on the temperature detected by the environment sensor (first temperature detection unit) and a temperature increase estimated from the operation status of the main body, and the printing operation is continued even when the cartridge temperature exceeds the threshold temperature under specific conditions. The cartridge temperature can be measured by using a non-contact thermometer such as a radiation thermometer, or a contact-type thermometer such as a thermocouple.

The cartridge temperature corresponds to the sum of the outside air temperature detected by the environment sensor and an increase in the temperature of the cartridge shown below. The CPU 201 and the RAM 203 constituting the image formation control unit 200 as a temperature information acquisition unit execute the program stored in the ROM 202 to thereby implement the estimation of the cartridge temperature described above. At this point, for the detection of the outside air temperature, the detection result of the thermistor (third temperature detection unit) that detects the temperature in the fixing unit after a sufficient time has elapsed from the stop of the operation, or the detection result based on the electrical resistance value of the transfer roller may be used. It is possible to determine that the entire internal portion of the apparatus is cooled in the case where the sufficient time has elapsed from the stop of the operation. A thermistor temperature during cooling is equal to the outside air temperature, and hence the thermistor temperature during cooling may be set as the outside air temperature. In addition, the electrical resistance value of the transfer roller changes depending on temperature, and hence, similarly to the measurement of the thermistor temperature, when the electrical resistance value can be measured during cooling, it is possible to estimate the outside air temperature based on the correlation between the electrical resistance value of the transfer roller that is experimentally determined in advance and temperature. The electrical resistance value of the transfer roller can be measured by using, e.g., the result of active transfer voltage control (ATVC). The ATVC is control in which constant current control that uses a predetermined current value is performed in an area where the recording material is not in the transfer nip, and the electrical resistance value of the transfer roller is estimated from a transfer output voltage in the constant current control. The cartridge is described as the container that contains a developer, but the container of the cleaning apparatus 6 to which the cleaning blade 6*a* serving as the cleaning member is mounted is also the container that contains the developer that is the waste toner. Further, the container of the developing apparatus 4 that contains toner for development is also the container that contains the developer. The detection or the estimation of the temperature of the cleaning apparatus 6 or the developing apparatus 4 is not limited to direct detection or estimation, and the temperature thereof may be represented by the cartridge temperature and the cartridge temperature may be detected or estimated.

Cartridge Temperature Increase Estimation Method

Before the description of specific processes performed by the image formation control unit 200 in the present embodiment, terms that need to be explained will be explained. As a convergence temperature Cx and a rate of change in temperature k, values determined by obtaining the correlation with the thermocouple or the radiation temperature in advance experimentally are used. The "cartridge temperature" in the following description of a cartridge temperature increase estimation method denotes a temperature increase with respect to the temperature detected by the environment sensor unless otherwise specified.

C: a counter indicative of the temperature of the cartridge 25 (1° C.=10000 counts)

Cx: a convergence temperature to which the temperature of the cartridge 25 converges ΔC: an amount of change in temperature of the cartridge 25 in one update k: a rate of change in temperature of the cartridge 25

$C_{print}$: a buffer that temporarily stores the value of the counter C indicative of the temperature of the cartridge 25 in the printing immediately before transition to "during cooling"

$Cx_{print}$: a buffer that temporarily stores the value of the convergence temperature Cx to which the temperature of the cartridge 25 converges in the printing immediately before transition to "during cooling"

Figure 5:
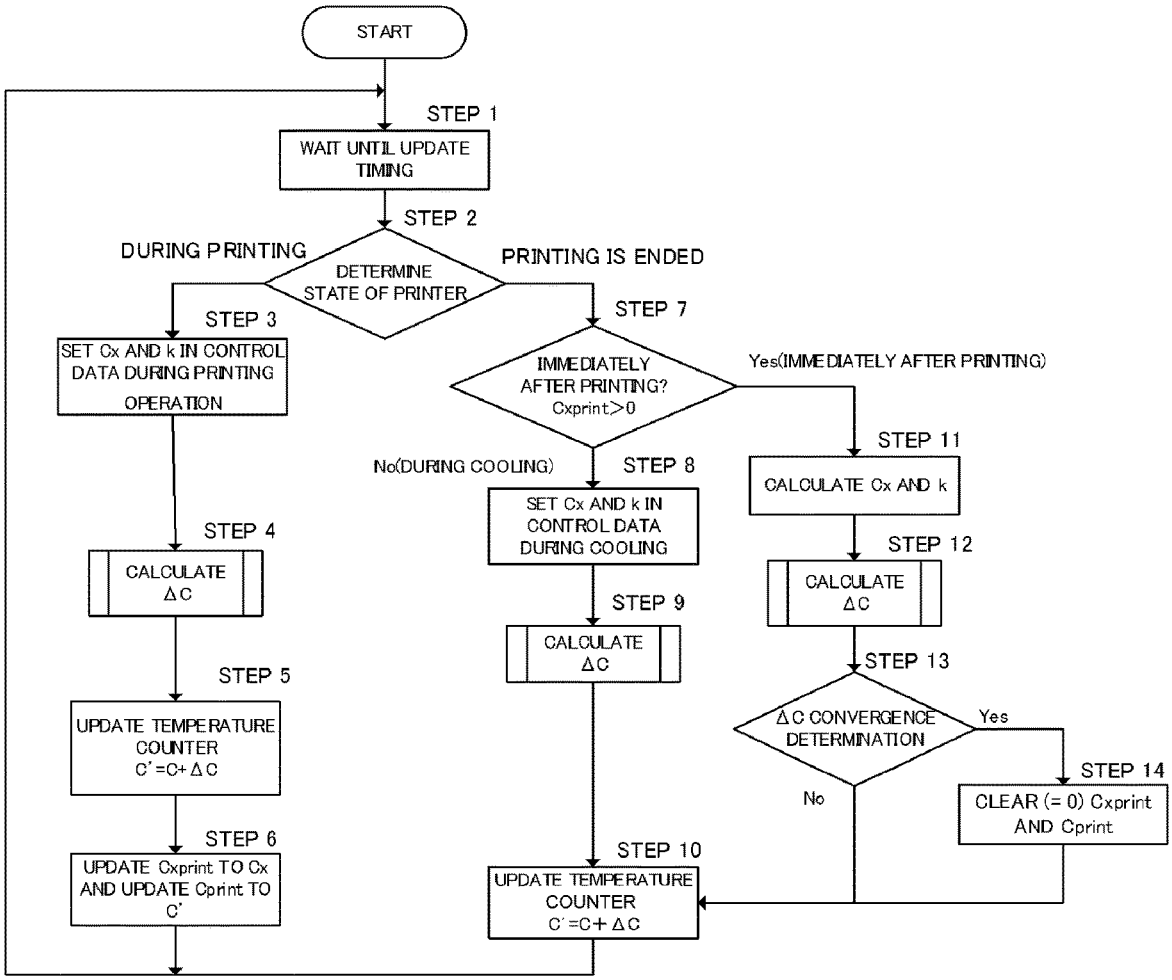
FIG. 5 is a control flowchart of cartridge temperature estimation in Embodiment 1.

The specific processes performed by the image formation control unit 200 in the present embodiment will be described by using FIG. 5. The calculation of the estimated temperature of the cartridge 25 in the embodiment is performed based on the temperature counter that performs addition or subtraction at predetermined intervals. Parameters used in an update process change depending on whether the state of the printer is "during printing", "immediately after printing", or "during cooling", and the actual cartridge temperature is simulated by incrementing or decrementing the counter in a counter update process according to the state of the printer.

First, the update process of the temperature counter during the printing operation will be described. First, in Step 1, the process waits until timing when the temperature counter is updated. The waiting time may be determined according to specifications of the image forming apparatus. When the update interval is extremely long, the printing operation is not noticed and accurate temperature estimation is not allowed, and hence the waiting time needs to be at least shorter than a time required to print one sheet. The waiting time is set to 1 second in the present embodiment.

Next, in Step 2, the state of the printer is determined. During the printing and a period immediately after the printing when an increase in the temperature of the cartridge 25 is continued, the counter C indicative of the cartridge temperature is incremented. The rate of change in temperature attenuates as time elapses, and the cartridge temperature converges to a given temperature in the course of time. After the temperature of the cartridge 25 converges to the convergence temperature, the state of the printer transitions to the state of "during cooling", and the counter C indicative of the cartridge temperature is decremented. An algorithm of the temperature counter in the present embodiment can be given by the following expression on the assumption that an operation is performed m times per minute at regular intervals (with regard to derivation of the expression, see Japanese Patent Application Publication No. 2007-286579).

$$\Delta C=(k/m)\times(Cx-C)$$

$$C'=C+\Delta C$$

where m=600000 (the counter is updated at intervals of 1 second, and hence 60 times×10000 counts) is satisfied.

In the case where the state of the printer is "during printing", the convergence temperature Cx to which the temperature of the cartridge 25 converges and the rate of change in temperature k of the cartridge 25 are set in Step 3. The convergence temperature Cx is determined based on a fixing unit temperature adjustment temperature during the printing. The higher the fixing unit temperature adjustment temperature is, the higher the convergence temperature Cx is. In the present embodiment, Cx "during printing" was set to 420000, and k "during printing" was set to 152.

The amount of change in temperature ΔC of the cartridge 25 is calculated in Step 4, and the temperature counter C is updated to C' by adding ΔC to the temperature counter C of the cartridge 25 in Step 5. In order to determine the state immediately before the end of the printing, the values of the convergence temperature Cx of the cartridge 25 and the temperature counter C of the cartridge 25 are stored in the buffers $Cx_{print}$ and $C_{print}$ that temporarily store the values in Step 6, and the process returns to Step 1.

Next, the update process of the temperature counter "immediately after printing" will be described. Similarly to "during printing", after the state of the printer is determined in Step 2, in Step 7, it is determined whether or not the state of the printer is "immediately after printing" by using the buffer $Cx_{print}$ in which the value is stored in Step 6. In the case where $Cx_{print}>0$ is satisfied, it is determined that the state of the printer is "immediately after printing".

In the case where it is determined that the state of the printer is "immediately after printing", the following process is performed in Step 11. That is, the convergence temperature Cx to which the temperature increase of the cartridge 25 converges and the rate of change in temperature k of the cartridge 25 are calculated after the end of the printing by using the values of the buffers $Cx_{print}$ and $C_{print}$ stored in Step 6. As the convergence temperature Cx and the rate of change in temperature k, values determined by obtaining the correlation with the thermocouple or the radiation temperature in advance experimentally are used. That is, the convergence temperature Cx and the rate of change in temperature k "immediately after printing" are constants, and the temperature in the state of "immediately after printing" is determined based on the temperature when the printing is ended and an elapsed time from when the printing is ended.

The amount of change in temperature ΔC of the cartridge 25 from the end of the printing in one update is determined in Step S12, and a convergence determination of the cartridge temperature is performed in Step 13. In the case where the amount of change in temperature ΔC of the cartridge 25 is sufficiently small and is less than a threshold value, as mentioned in FIG. 3, it is determined that the temperature increase since "immediately after printing" has converged, and the state of the printer has transitioned to "during cooling". In order to transition to the cooling state from the next update, the values in the buffers $Cx_{print}$ and $C_{print}$ are cleared in Step 14, the temperature counter C of the cartridge 25 is updated in Step 10 lastly, and the process returns to Step 1.

In the case where it is determined that the state of the printer has transitioned to "during cooling" in Step 7, control data for the cooling state (the convergence temperature Cx to which the temperature of the cartridge 25 converges and the rate of change in temperature k of the cartridge 25) are set for the counter C indicative of the temperature of the cartridge 25. In the present embodiment, Cx "during cooling" was set to 15000, and k "during cooling" was set to 120. Next, the amount of change in temperature ΔC of the cartridge 25 is calculated in Step 9, the temperature counter C of the cartridge 25 is updated in Step 10 lastly, and the process returns to Step 1. That is, similarly to the temperature in the state of "immediately after printing", the convergence temperature Cx and the rate of change in temperature k "during cooling" are constants, and the temperature in the state of "during cooling" is determined based on the temperature when the printing is ended and the elapsed time from when the printing is ended.

As described thus far, the cartridge temperature is detected by updating the cartridge temperature at regular intervals based on pieces of information such as the operation state of the apparatus, a printing mode, and the outside air temperature. In addition, the cartridge temperature after the end of the printing is determined based on the temperature when the printing is ended and the elapsed time from when the printing is ended.

Temperature Increase Prevention Control in Present Embodiment

The printer of the present embodiment has a first mode in which the printing operation is suspended when a first time elapses from the start of the printing operation, and a second mode in which the printing operation is suspended when a second time longer than the first time elapses from the start of the printing operation. The printer performs control in which, when the printing operation is started, one of the first mode and the second mode is selected and executed based on the temperature of the cartridge when the previous printing operation is suspended and an elapsed time from when the previous printing operation is suspended.

That is, in the case where a cooling time sufficient for the temperature when the previous printing operation is suspended (ended) has elapsed, it is possible to execute the second mode in the next printing operation.

On the other hand, in the case where the cooling time is not sufficient for the temperature when the previous printing operation is suspended (ended), it is possible to execute the first mode in the next printing operation.

Hereinbelow, the control in the present embodiment will be described in greater detail.

Figure 6A:
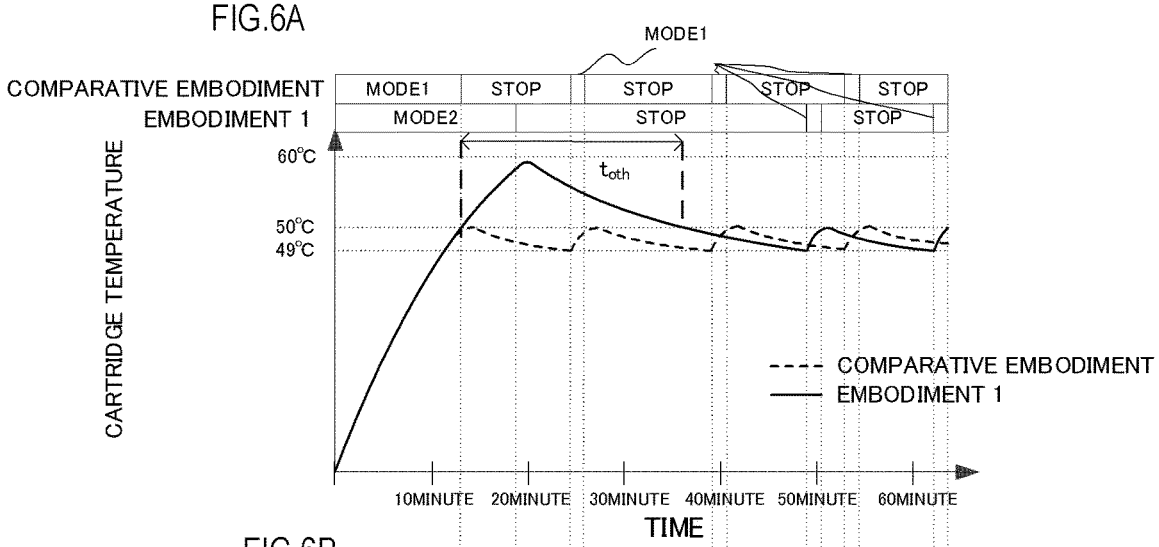
FIG. 6A and FIG. 6B are views showing cartridge temperature and productivity in Comparative Embodiment and Embodiment 1.

In the present embodiment, as shown in FIG. 6A, two types of paper feed (recording) modes are set, and the paper feed mode is switched according to the cartridge temperature. First, each mode will be described.

"Mode 1" serving as the first mode is the mode in which the printing operation is stopped, i.e., the suspension operation is executed when the temperature of the cartridge exceeds 50° C. and, thereafter, the printing operation is resumed when the temperature becomes equal to or less than 49° C.

"Mode 2" serving as the second mode is the mode in which the printing operation is continued for a predetermined period even when the temperature of the cartridge exceeds 50° C., and is the operation at a temperature in the vicinity of the glass transition temperature (Tg) of the toner or a temperature exceeding the glass transition temperature (Tg).

According to the above-described measurement of the glass transition temperature (Tg) of the toner, the sticking did not occur when the standing time was not more than 30 minutes at 60° C. Based on the result, the printer operates in "Mode 2" when the period during which the cartridge temperature is at least 50° C. and not more than 60° C. is not more than 30 minutes ($=T_{oth}$). With regard to the timing of stop of the printing operation, the elapsed time (cooling time) until the cartridge temperature becomes equal to or less than 50° C. after the end of the previous printing operation is calculated, and the printer operates such that the sum of the elapsed time and the period during which the cartridge temperature is not less than 50° C. does not exceed 30 minutes. That is, after the printing operation is stopped, the state in which the cartridge temperature is not less than 50° C. continues until the calculated cooling time described above elapses, and hence "Mode 2" is ended when the period during which the cartridge temperature is not less than 50° C., which includes the cooling time, exceeds 30 minutes. Herein, let t be defined as the elapsed time from when the cartridge temperature exceeds 50° C. serving as the threshold temperature (T) during the printing operation, and let $t_{oth}$ be defined as an exceeding time threshold value related to a period during which the cartridge temperature remains higher than the threshold temperature $T_{th}$. In this case, the printing operation is suspended in the case where $t \geq t_{oth}$ ($t_{oth} \neq 0$) is satisfied. Herein $t_{oth} \neq 0$ is satisfied, and hence, in the temperature increase prevention control in the present embodiment, instead of immediately suspending the image formation operation when the cartridge temperature exceeds the threshold temperature $T_{th}$, the image formation operation is continued in the case where $t < t_{oth}$ is satisfied. The timing of suspension of the image formation operation will be described more specifically by using, as an example, the case where the cartridge temperature changes in a manner shown in FIG. 6A. In this case, when the image formation operation is suspended after the cartridge temperature exceeds 50° C. serving as the threshold temperature, the cartridge temperature decreases, and becomes equal to or less than 50° C. Thus, the image formation operation is suspended at the timing when the period during which the cartridge temperature remains higher than the threshold temperature, which includes the cooling time after the suspension, i.e., the elapsed time t from when the threshold temperature is exceeded is to exceed the exceeding time threshold value $t_{oth}$. Herein, as the cooling time, it is possible to use information during the previous printing operation, but the information that can be used is not limited thereto. In "Mode 1" described above, an elapsed time until the cartridge temperature exceeds 50° C. from the start of the printing operation is the first time. In "Mode 2", a time that allows the period during which the cartridge temperature is not less than 50° C. to fall within 30 minutes when the printing operation is suspended at the timing of lapse of the second time is the second time. In "Mode 1", the printing operation is not permitted in a state in which the cartridge temperature is not less than 50° C. While in "Mode 2", the printing operation in the state in which the cartridge temperature is not less than 50° C. is permitted under predetermined conditions. Consequently, the second time is longer than the first time.

Even when the cartridge temperature becomes equal to or less than 50° C. after the printing operation in "Mode 2" described above is suspended, "Mode 1" is executed instead of executing "Mode 2" again. If "Mode 2" is executed again after the cartridge temperature is reduced to 50° C. by cooling, the period during which the cartridge temperature is not less than 50° C. is already more than 30 minutes, and hence the period during which the cartridge temperature is not less than 50° C. is prolonged beyond 30 minutes. Consequently, after the cartridge temperature is reduced to 50° C. by cooling after paper feed in "Mode 2", "Mode 1" is executed, and the cartridge temperature is controlled so as not to exceed 50° C.

Figure 7A:
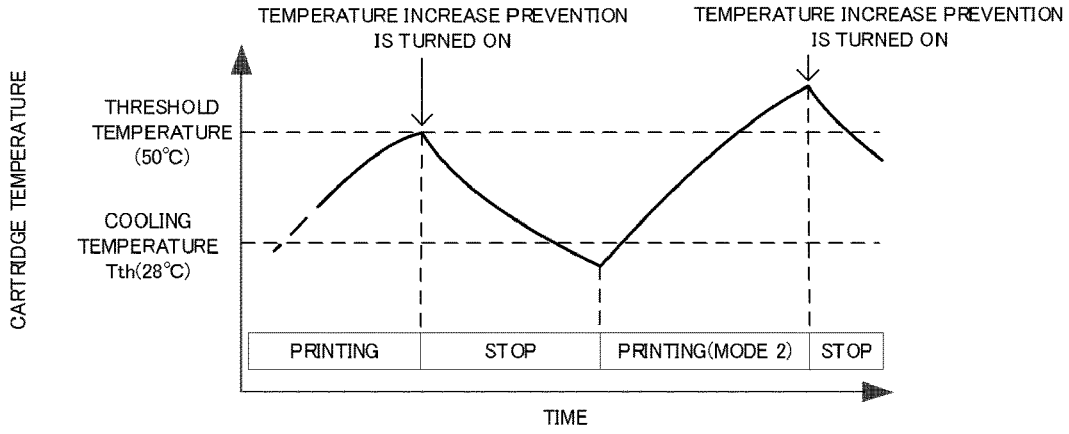
FIG. 7A to FIG. 7C show examples of mode switching conditions in Embodiment 1.
Figure 7B:
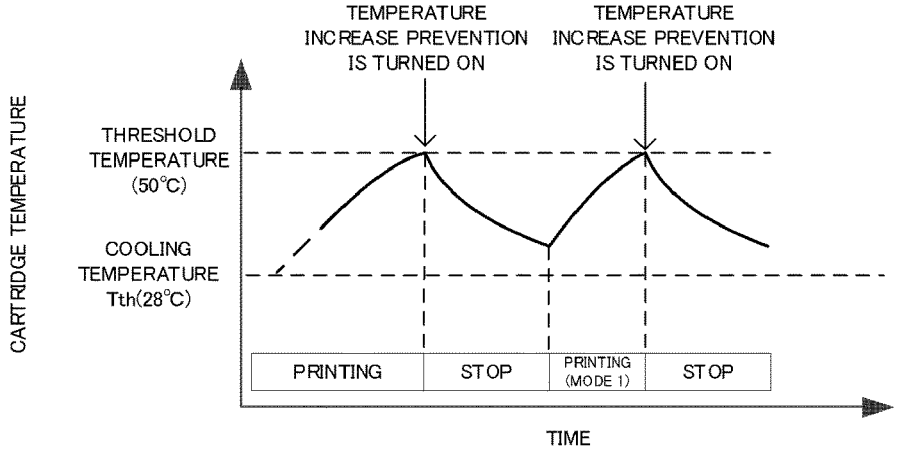
Figure 7C:
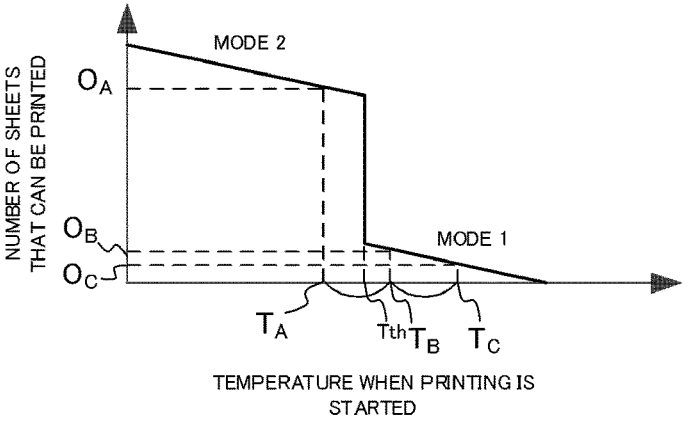

In the case where, after the printing operation in "Mode 2", the cartridge temperature decreases, the cartridge is sufficiently cooled, and the cartridge temperature is lower than a threshold temperature $T_{th}$ as shown in FIG. 7A, it is determined that the cartridge is cooled, and the execution of "Mode 2" is permitted again. In the case where the cartridge temperature exceeds the threshold temperature $T_{th}$, the sticking of the toner is prevented by executing "Mode 1" shown in FIG. 7B. In each of FIGS. 7A and 7B, the previous temperature increase prevention control is turned ON when the cartridge temperature reaches the threshold temperature for clarifying the change of the cartridge temperature after the previous printing operation is stopped. In the case where the temperature increases in a state in which the cartridge is cooled, the portion of the cartridge container where temperature is high is a surface on the side of the fixing unit. Consequently, only the toner adhering to the surface is most influenced, and the sticking of the toner is less likely to occur. On the other hand, in the case where the temperature increases in a state in which the cartridge is warmed, the entire cartridge container is warmed, and hence the temperature of the entire toner in the container increases, and the sticking of the toner easily occurs. Consequently, when the cartridge is cooled after paper feed in "Mode 2", the number of sheets that can be printed is increased as shown in FIG. 7C by permitting the execution of "Mode 2" again, and productivity is increased. In the present embodiment, when an increase in the temperature of the cartridge is not more than 5° C., i.e., when the cartridge temperature is not more than 28° C. with an environment temperature of 23° C., it is determined that the cartridge is cooled. At this point, a first temperature $T_A$, a second temperature $T_B$, and a third temperature $T_C$ each serving as a temperature when the printing is started are defined to be set at regular intervals, i.e., they are set so as to satisfy $T_C - T_B = T_B - T_A$ ($T_A > T_{th} > T_B > T_C$). When $O_A$, $O_B$, and $O_C$ are defined to be the numbers of sheets that can be printed from when the printing is started at the temperatures, $O_A - O_B > O_B > O_C$ is satisfied. Note that, when the sticking of the toner is liable to occur due to toner degradation caused by endurance or the like, the execution of "Mode 2" may be prohibited.

A condition for the operation at a cartridge temperature of at least 50° C. and not more than 60° C. may be specified based on the number of sheets (recording material having been subjected to recording that serves as a result of a recording operation) instead of time. In this case, the cartridge temperature is measured in advance in the case where paper is fed by a paper feed method that maximizes an increase in the temperature of the cartridge from when the cartridge is cooled, the number of sheets that allows a time from when the cartridge temperature exceeds 50° C. to when the cartridge temperature reaches 60° C. to fall within 30 minutes is set, and the printer operates in "Mode 2" correspondingly to the number of sheets. An example of the paper feed method that maximizes the increase in the temperature of the cartridge includes a "one-sheet advancement intermittent paper feed" in which the printing operation is stopped after one sheet is fed, and the next printing operation is started immediately after the stop. The "one-sheet advancement intermittent paper feed" is the paper feed method that maximizes the increase in the temperature of the cartridge using a small number of sheets. This is because the fixing unit generates heat before and after the sheet enters the fixing unit, and hence the heat generation time of the fixing unit per one sheet to be fed is maximized. In the case where paper was fed by the paper feed method, a time from when the temperature of the container exceeded 50° C. to when the temperature thereof reached 60° C. was not more than 30 minutes when about 100 sheets were fed. Accordingly, in the case where the condition is specified based on the number of sheets, the number of sheets to be fed in "Mode 2" is set to 100 sheets ($=p_{oth}$).

Figure 8A:
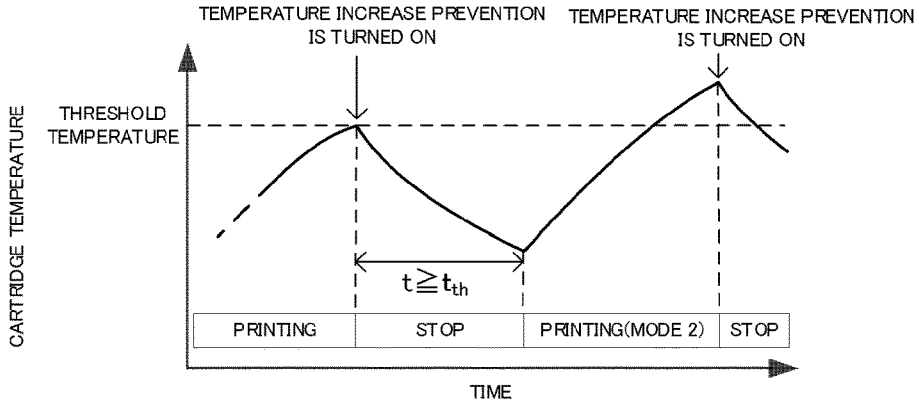
FIG. 8A to FIG. 8C show examples of the mode switching conditions in Embodiment 1.
Figure 8B:
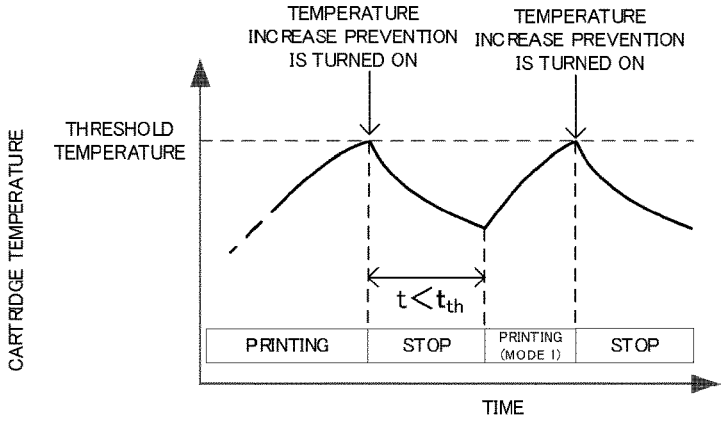
Figure 8C:
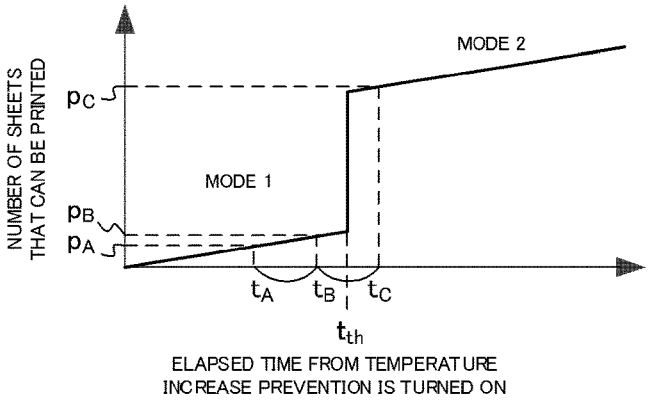

A condition for allowing the operation in "Mode 2" again after paper feed in "Mode 2" may be determined based on, instead of the estimated temperature of the cartridge, the elapsed time from when the temperature increase prevention control is started, i.e., from when the previous printing operation is ended. In the case where an elapsed time t from when the temperature increase prevention control is turned ON is not less than a predetermined elapsed time threshold value $t_{th}$, it is determined that the cartridge is cooled, and "Mode 2" is selected as shown in FIG. 8A. On the other hand, in the case where the time t is less than the elapsed time threshold value $t_{th}$, it is determined that the cartridge is not cooled, and "Mode 1" is selected as shown in FIG. 8B. That is, as shown in FIG. 8C, "Mode 1" or "Mode 2" is selected according to whether the time t from when the temperature increase prevention control is turned ON exceeds the threshold value $t_{th}$. In each of FIGS. 8A and 8B, the previous temperature increase prevention control is turned ON when the cartridge temperature reaches the threshold temperature for clarifying the lapse of time from the stop of the previous printing operation. When a first time $t_A$, a second time $t_B$, and a third time $t_C$ each serving as the elapsed time from the temperature increase prevention control are defined to be set at regular intervals, i.e., they are set so as to satisfy $t_C-t_B=t_B-t_A$ ($t_A<t_B<t_{th}<t_C$), and $p_A$, $p_B$, and $p_C$ are defined to be the numbers of prints corresponding to the individual times, $p_C-p_B>p_B>p_A$ is satisfied.

After the start of the temperature increase prevention control, a time required for the increase in the temperature of the cartridge measured using the radiation thermometer to become equal to or less than 5° C. was 62 minutes, and hence $t_{th}$ is set to 62 minutes in the case where the condition is specified based on time.

In the example described above, the cartridge temperature is determined by calculating the sum of the outside air temperature detected by the environment sensor and the increase in the temperature of the cartridge estimated by using the temperature counter. At this point, the temperature counter used in the calculation of the estimated temperature of the cartridge performs addition or subtraction at predetermined intervals, and the estimated temperature of the cartridge is obtained based on the elapsed time from the start of the printing operation to the end thereof. In addition, the parameters Cx and k used in the estimation by the temperature counter are set in accordance with various pieces of information that influence the temperature change of the cartridge. Examples of the information include a stop time from the end of the previous printing operation to the next printing operation, the fixing temperature of the fixing unit, the electrical resistance value of the transfer roller, the process speed of an image formation process for forming an image, an image formation mode for forming an image, and the size of the recording material used in image formation.

In addition, a condition for allowing the operation in "Mode 2" again after paper feed in "Mode 2" may be set by using the detection result of the thermistor that detects the temperature in the fixing unit or the detection result based on the electrical resistance value of the transfer roller. When the thermistor temperature in the fixing unit serving as the heat source is substantially equal to the room temperature, it is possible to determine that the inside of the apparatus is sufficiently cooled. In addition, the temperature in the apparatus is estimated based on the correlation between the transfer roller resistance and the temperature that is experimentally determined in advance by using the detection result of the resistance of the ATVC of the transfer roller and, when it is possible to determine that the temperature in the apparatus is sufficiently low, it is possible to permit the execution of "Mode 2" again.

Temperature Increase Prevention Control in Comparative Embodiment

In the Comparative Embodiment, as shown in FIG. 6A, only "Mode 1" is set, the printing operation is stopped when the cartridge temperature exceeds 50° C., and the printing operation is resumed when the cartridge temperature becomes equal to or less than 49° C.

Result of Sticking of Toner in Each of Present Embodiment and Comparative Embodiment A description will be given of the result of the sticking of the toner after paper feed of each of the present embodiment and the Comparative Embodiment shown in FIG. 6A is performed. In the Comparative Embodiment, as indicated by the measurement result of the glass transition temperature (Tg) of the toner described above, when the cartridge temperature was not more than 50° C., the sticking of the toner did not occur even when the printing operation was continued for a long time. When the toner in the cartridge after the paper feed of the present experiment was observed, the occurrence of the sticking of the toner was not observed and no problem was presented. In the present embodiment, as indicated by the measurement result of the glass transition temperature (Tg) of the toner described above, when the cartridge temperature was not more than 60° C., the sticking of the toner did not occur even when the printing operation was continued for 30 minutes. In the present experiment, a period $t_{oth}$ during which the cartridge temperature was at least 50° C. and not more than 60° C. was 26 minutes, which is not more than 30 minutes, and hence the sticking of the toner did not occur and no problem was presented.

In the present embodiment, the time that does not allow the sticking was set to 30 minutes or less. However, when a stirring member or the like is provided in the developer container or the waste toner container, there are cases where the sticking does not occur for a longer time. In addition, orientation relative to the vertical direction of the developer container or the waste toner container influences the occurrence of the sticking. When the vertical direction of the container in which the toner tends to accumulate does not match the inlet of the container, faulty cleaning caused by the sticking of the toner or the like is less likely to occur.

Productivity Comparison Between Present Embodiment and Comparative Embodiment

Figure 6B:
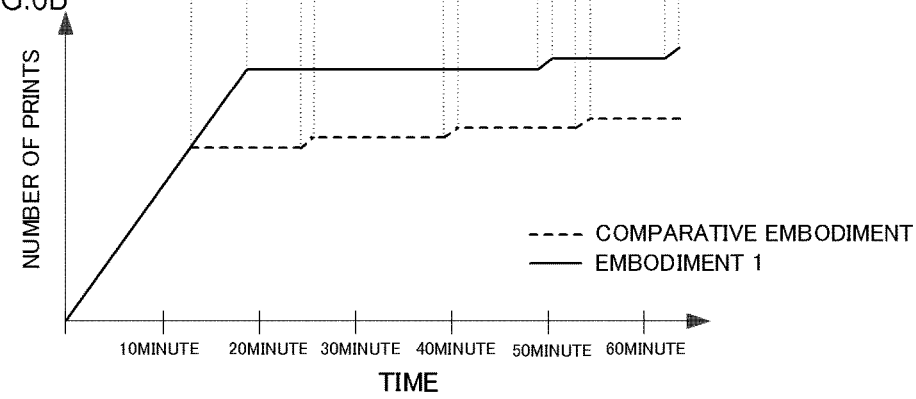

FIG. 6B is a graph showing the printing operation and productivity in each of the present embodiment and Comparative Embodiment in the case where a printing signal is continuously sent to the printer. In the present embodiment, the printer operates in "Mode 2" that allows the range of the cartridge temperature of at least 50° C. and not more than 60° C. when the period during which the cartridge temperature is at least 50° C. and not more than 60° C. is not more than 30 minutes and, thereafter, the printer operates in "Mode 1" such that the cartridge temperature becomes equal to or less than 50° C. until the cartridge is cooled. In Comparative Embodiment, the printer operates in "Mode 1" in either case.

As shown in FIGS. 3 and 4, the increase in the temperature of the cartridge continues after the end of the printing and, the higher the temperature when the printing is ended is, the smaller the amount of the temperature increase is. Consequently, the productivity of the printing is more improved in the case where printing of a large number of sheets is performed as in the present embodiment than in the case where printing of a small number of sheets and the short stop of the operation of the main body are repeated as in Comparative Embodiment.

Thus, as in the present embodiment, the cartridge temperature is estimated and the mode is switched based on the estimated temperature, whereby it becomes possible to prevent the sticking of the toner and improve the productivity of the printing.

Embodiment 2

Next, another embodiment of the present invention will be described. The basic configuration and operation of the image forming apparatus of the present embodiment are substantially the same as those of Embodiment 1. Consequently, elements having functions and configurations identical or corresponding to those of the image forming apparatus of Embodiment 1 are designated by the same reference numerals, and the detailed description thereof will be omitted.

Figure 9:
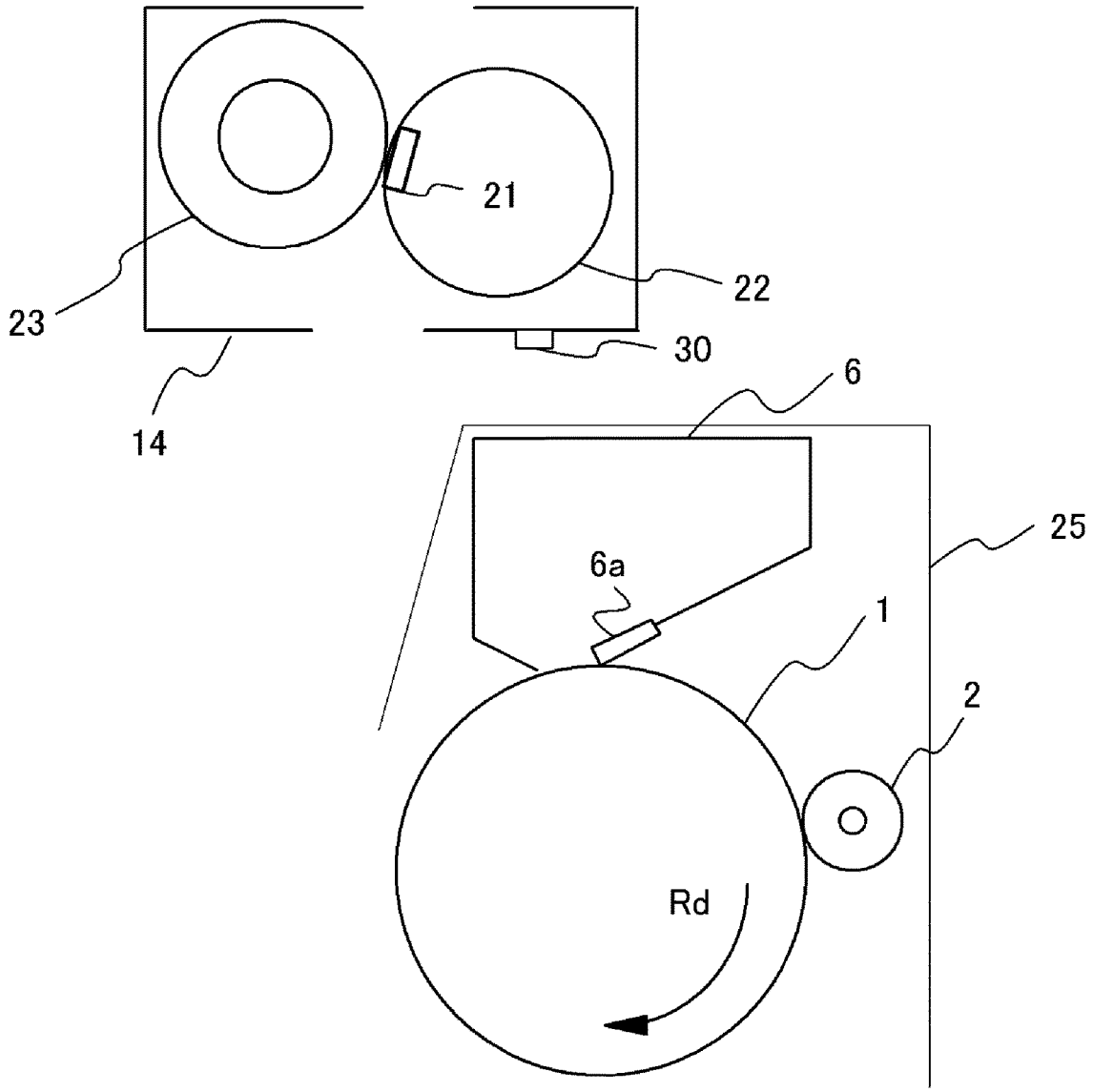
FIG. 9 is a schematic cross-sectional view of the image forming apparatus in Embodiment 2.

In Embodiment 1, as the cartridge temperature, the sum of the outside air temperature of the environment sensor and the increase in the temperature of the cartridge estimated by the operation of the main body is used in the temperature increase prevention control. The cartridge temperature can be measured directly by using the non-contact thermometer such as the radiation thermometer, or the contact-type thermometer such as the thermocouple that serves as a second temperature detection unit. In the present embodiment, a non-contact infrared radiation thermometer 30 that directly measures the cartridge temperature is disposed on the side of the main body as shown in FIG. 9, and the temperature is used in the control of the main body. The operation that uses the measured temperature and corresponds to the cartridge temperature is the same as that in Embodiment 1. Note that the configuration of the present embodiment needs the temperature sensor, and hence cost is increased. However, the temperature is directly measured, and hence accuracy in the detection of the cartridge temperature is increased. Consequently, it is possible to prevent a bad effect such as stopping the operation of the main body through the threshold temperature is not actually exceeded.

Thus, according to the present embodiment, although cost is increased, it becomes possible to increase accuracy in detection by actually measuring the cartridge temperature, and prevent a reduction in productivity.

Embodiment 3

Next, another embodiment of the present invention will be described. The basic configuration and operation of the image forming apparatus of the present embodiment are substantially the same as those of Embodiment 1. Consequently, elements having functions and configurations identical or corresponding to those of the image forming apparatus of Embodiment 1 are designated by the same reference numerals, and the detailed description thereof will be omitted.

In each of Embodiments 1 and 2, the information related to the temperature increase prevention control such as the cartridge temperature is stored in the storage area of the main body of the apparatus, and the printing mode is selected according to the information. In the present embodiment, the information related to the temperature increase prevention control is recorded in a storage area mounted to the cartridge. For example, in the case where paper is fed for a long time, the cartridge whose temperature is increased is installed in another main body that is cooled, and the printing is performed, it is determined that the cartridge is also cooled when the configuration of Embodiment 1 is used. In this case, the printer performs the same operation as that in the case where the cartridge is cooled, and hence a high temperature state is maintained for an unexpectedly long time, and the risk of the sticking of the toner is increased. Consequently, as in the present embodiment, by storing the estimated temperature of the cartridge in the storage area of the cartridge, it is possible to detect the cartridge temperature corresponding to each cartridge even when the cartridge is installed in a different apparatus. However, in this case, it is necessary to store time information or the like in addition to the cartridge temperature. By determining an elapsed time from when the cartridge is detached from the apparatus until when the cartridge is installed in another apparatus, it becomes possible to estimate the temperature when the cartridge is installed in another apparatus.

Thus, as in the present embodiment, by storing the information related to the temperature increase prevention control such as the cartridge temperature in the storage area of the cartridge, even in the case where the cartridge is installed in another apparatus, it is possible to detect the cartridge temperature corresponding to the cartridge. Consequently, in the case where the cartridge is installed in another apparatus as well, it becomes possible to prevent the sticking of the toner and improve the productivity of the printing similarly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-009050, filed on Jan. 23, 2018, which is hereby incorporated by reference herein in its entirety.

What is claimed is:

1. An image forming apparatus comprising:

a container configured to contain a developer;

a temperature information acquisition unit configured to acquire temperature information of the container; and a control unit configured to control an image formation operation for forming an image, wherein, in the image formation operation, the control unit executes a suspension operation for suspending the image formation operation in a case that $t \geq t_{oth}$ ($t_{oth} \neq 0$) is satisfied, where t is defined to be an elapsed time from when a temperature corresponding to the temperature information of the container exceeds a predetermined threshold temperature $T_{th}$, and where $t_{oth}$ is defined to be an exceeding time threshold value related to a period during which the temperature corresponding to the temperature information of the container remains higher than the threshold temperature $T_{th}$.

2. The image forming apparatus according to claim 1, wherein, the control unit does not execute the suspension operation and continues the image formation operation in a case that $t < t_{oth}$ is satisfied, while the temperature corresponding to the temperature information of the container exceeds the threshold temperature $T_{th}$.

3. The image forming apparatus according to claim 1, wherein the control unit has:

a first mode in which the image formation operation is suspended when a first time elapses from a start of the image formation operation; and a second mode in which the image formation operation is suspended when a second time longer than the first time elapses from the start of the image formation operation, and the control unit selects one of the first mode and the second mode to execute, based on the temperature corresponding to the temperature information of the container when the image formation operation is started.

4. The image forming apparatus according to claim 3, wherein, in a case that the control unit determines the number of sheets of a recording material on which an image can be formed from when the image formation operation is started until when the suspension operation is to be executed based on the temperature corresponding to the temperature information of the container, $$T_C - T_B = T_B - T_A$$

$$T_A < T_{th} < T_B < T_C \text{ and,}$$

$$O_A - O_B > O_B > O_C \text{ are satisfied,}$$

where $O_A$ is defined to be the number of sheets of the recording material on which the image can be formed in a case that the temperature corresponding to the temperature information of the container when the image formation operation is started is defined to be a first temperature $T_A$, where $O_B$ is defined to be the number of sheets of the recording material on which the image can be formed in a case that the temperature corresponding to the temperature information of the container when the image formation operation is started is defined to be a second temperature $T_B$, and where $O_C$ is defined to be the number of sheets of the recording material on which the image can be formed in a case that the temperature corresponding to the temperature information of the container when the image formation operation is started is defined to be a third temperature $T_C$.

5. The image forming apparatus according to claim 1, further comprising:

a temperature detection unit configured to detect an environment temperature, wherein the temperature information acquisition unit acquires the temperature information of the container based on a detection result of the temperature detection unit.

6. The image forming apparatus according to claim 5, wherein the temperature information acquisition unit acquires the temperature information based on at least one type of information related to an elapsed time from when the image formation operation is started until when the image formation operation is ended, a stop time from when a previous image formation operation is ended until when a next image formation operation is started, a fixing temperature of a fixing unit, a process speed of an image formation process for forming an image, an image formation mode for forming an image, and a size of the recording material used in image formation.

7. The image forming apparatus according to claim 1, further comprising:

a temperature detection unit configured to detect a temperature of the container configured to contain the developer, wherein the temperature information acquisition unit acquires the temperature information of the container based on a detection result of the temperature detection unit.

8. The image forming apparatus according to claim 1, further comprising:

a transfer roller configured to transfer a developer image that is developed from an electrostatic latent image using the developer, wherein the temperature information acquisition unit acquires the temperature information of the container based on an electrical resistance value of the transfer roller.

9. The image forming apparatus according to claim 1, further comprising:

a fixing unit configured to fix a developer image that is transferred to a recording material; and a temperature detection unit configured to detect a temperature in the fixing unit, wherein the temperature information acquisition unit acquires the temperature information of the container based on a detection result of the temperature detection unit.

10. The image forming apparatus according to claim 1, further comprising:

a storage unit mounted to the container, the storage unit configured to store temperature information of the container, wherein the temperature information acquisition unit acquires the temperature information based on the temperature information stored in the storage unit.

11. The image forming apparatus according to claim 1, further comprising:

an image bearing member provided in the container, the image bearing member configured to bear a developer image that is developed from an electrostatic latent image using the developer; and a cleaning member provided in the container, the cleaning member configured to remove the developer that remains on the image bearing member without being transferred to a transfer material from the image bearing member, wherein the developer removed by the cleaning member is contained in the container.

12. An image forming apparatus comprising:

a container configured to contain a developer;

a temperature information acquisition unit configured to acquire temperature information of the container; and a control unit configured to control an image formation operation for forming an image on a recording material, wherein, in the image formation operation, the control unit executes a suspension operation in a case that $p \geq p_{oth}$ is satisfied, where p is defined to be a number of sheets of the recording material on which the image is formed after a temperature corresponding to the temperature information of the container exceeds a predetermined threshold temperature $T_{th}$, and where $p_{oth}$ ($p_{oth} \neq 0$) is defined to be a threshold value of the number of sheets of the recording material on which the image can be formed from when the temperature corresponding to the temperature information of the container exceeds the threshold temperature $T_{th}$ until when a suspension operation for suspending the image formation operation is executed.

13. The image forming apparatus according to claim 12, wherein, the control unit does not execute the suspension operation and continues the image formation operation in a case that $p < p_{oth}$ is satisfied, while the temperature corresponding to the temperature information of the container exceeds the threshold temperature $T_{th}$.

14. The image forming apparatus according to claim 12, wherein the control unit has:

a first mode in which the image formation operation is suspended when a first time elapses from a start of the image formation operation; and a second mode in which the image formation operation is suspended when a second time longer than the first time elapses from the start of the image formation operation, and the control unit selects one of the first mode and the second mode to execute based on the temperature corresponding to the temperature information of the container when the image formation operation is started.

15. The image forming apparatus according to claim 14, wherein, in a case that the control unit determines the number of sheets of the recording material on which the image can be formed from when the image formation operation is started until when the suspension operation is to be executed based on the temperature corresponding to the temperature information of the container, $$T_C - T_B = T_B - T_A,$$

$$T_A < T_{th} < T_B < T_C, \text{ and}$$

$$O_A - O_B > O_B > O_C \text{ are satisfied,}$$

where $O_A$ is defined to be the number of sheets of the recording material on which the image can be formed in a case that the temperature corresponding to the temperature information of the container when the image formation operation is started is defined to be a first temperature $T_A$, where $O_B$ is defined to be the number of sheets of the recording material on which the image can be formed in a case that the temperature corresponding to the temperature information of the container when the image formation operation is started is defined to be a second temperature $T_B$, and where $O_C$ is defined to be the number of sheets of the recording material on which the image can be formed in a case that the temperature corresponding to the temperature information of the container when the image formation operation is started is defined to be a third temperature $T_C$.

16. An image forming apparatus comprising:

a container configured to contain a developer;

an elapsed time acquisition unit configured to acquire information on an elapsed time from when an image formation operation for forming an image on a recording material is ended; and a control unit configured to control the image formation operation, wherein, the control unit controls such that the number of sheets of the recording material on which the image can be formed in a next image formation operation in a case that the elapsed time t is not less than a predetermined elapsed time threshold value $t_{th}$, is greater than that in a case that the elapsed time t is less than the elapsed time threshold value $t_{th}$;

where t is defined to be an elapsed time from when a previous image formation operation is ended until when the next image formation operation is started.

17. The image forming apparatus according to claim 16, wherein, in a case that the control unit determines the number of sheets of the recording material on which the image can be formed in the next image formation operation, $$t_C - t_B = t_B - t_A,$$

$$t_A < t_B < t_{th} < t_C, \text{ and,}$$

$$p_A - p_B > p_B > p_C \text{ are satisfied,}$$

where $p_A$ is defined to be the number of sheets of the recording material on which the image can be formed in a case that an elapsed time from when the previous image formation operation is ended is defined to be a first time $t_A$, where $p_B$ is defined to be the number of sheets of the recording material on which the image can be formed in a case that the elapsed time from when the previous image formation operation is ended is defined to be a second time $t_B$, and where $p_C$ is defined to be the number of sheets of the recording material on which the image can be formed in a case that the elapsed time from when the previous image formation operation is ended is defined to be a third time $t_C$.

18. An image forming apparatus comprising:

a container configured to contain a developer;

an elapsed time acquisition unit configured to acquire information on an elapsed time from when an image formation operation for forming an image on a recording material is ended; and a control unit configured to control the image formation operation, the control unit having:

a first mode in which the image formation operation is suspended when a first time elapses from a start of the image formation operation; and a second mode in which the image formation operation is suspended when a second time longer than the first time elapses from the start of the image formation operation, wherein the control unit selects one of the first mode and the second mode to execute based on an elapsed time from when a previous image formation operation is suspended when the image formation operation is started.

* * * * *